US006359546B1

(12) United States Patent
Oh

(10) Patent No.: US 6,359,546 B1
(45) Date of Patent: Mar. 19, 2002

(54) CHIP DEVICE, AND METHOD OF MAKING THE SAME

(75) Inventor: Soon Hee Oh, Taegu-si (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 09/436,822

(22) Filed: Nov. 9, 1999

(30) Foreign Application Priority Data

Jan. 27, 1999 (KR) ..... 99-2499
Sep. 13, 1999 (KR) ..... 99-38950

(51) Int. Cl.[7] ..... H01C 1/01
(52) U.S. Cl. ..... 338/313; 338/309; 338/332
(58) Field of Search ..... 338/307, 308, 338/309, 313, 332; 29/620, 621

(56) References Cited

U.S. PATENT DOCUMENTS

| | | | | | |
|---|---|---|---|---|---|
| 4,510,179 | A | * | 4/1985 | Honjo et al. | 427/96 |
| 4,684,916 | A | * | 8/1987 | Ozawa | 338/308 |
| 4,780,702 | A | * | 10/1988 | Snel et al. | 338/308 |
| 5,379,017 | A | * | 1/1995 | Katsuno | 338/313 |
| 5,815,065 | A | | 9/1998 | Hanamura | |
| 5,907,274 | A | * | 5/1999 | Kimura et al. | 338/309 |
| 5,917,403 | A | * | 6/1999 | Hashimoto et al. | 338/307 |
| 5,966,067 | A | * | 10/1999 | Murakami et al. | 338/309 |
| 5,990,781 | A | * | 11/1999 | Kambara | 338/309 |
| 6,005,474 | A | * | 12/1999 | Takeuchi et al. | 338/320 |
| 6,023,217 | A | * | 2/2000 | Yamada et al. | 338/309 |
| 6,150,920 | A | * | 11/2000 | Hashimoto et al. | 338/309 |

FOREIGN PATENT DOCUMENTS

| | | | | |
|---|---|---|---|---|
| JP | 1-8601 | * | 1/1989 | 29/620 |
| JP | 2-224202 | * | 9/1990 | 29/620 |
| JP | 3-110803 | * | 5/1991 | 29/620 |
| JP | 5-21205 | * | 1/1993 | 29/610.1 |

OTHER PUBLICATIONS

Tobfer, M. J. Thick–Film Microelectronics, pp. 43–52 (1971).*

* cited by examiner

*Primary Examiner*—Karl D. Easthom
(74) *Attorney, Agent, or Firm*—Renner, Otto, Boisselle & Sklar, LLP

(57) ABSTRACT

A chip device and a manufacturing method therefor are disclosed, in which the resistivity of the chip resistor device is constantly maintained even without using silver for lowering the self resistance in portions other than the upper electrode, thereby curtailing the manufacturing cost of the chip resistor. The chip resistor device 1 includes a chip block 10 having an upper face 12 and a pair of mutually oppositely facing side faces 14. An electrode part 20 has an upper electrode 22 formed on the upper face 12 of the chip block 10, and a side electrode 24 formed on the side faces 14 of the chip block 10. A special electrical property layer 30 is connected to the upper electrode 22 of the chip block 10. A protecting layer 40 is formed upon the special electrical property layer 30 to protect it. A terminal electrode layer 50 is formed on the electrode part 20 of the chip block 10, and a terminal connection part S is necessarily provided to form a signal bypassing path. In this chip device, even without using silver in the electrodes other than the upper electrode, the resistance characteristics of the chip resistor device are maintained constantly, so as to make it possible to save the manufacturing cost.

16 Claims, 14 Drawing Sheets

PRIOR ART

PRIOR ART

PRIOR ART

CHIP DEVICE, AND METHOD OF MAKING THE SAME

BACKGROUND OF THE INVENTION

1. Field of the Invention

The present invention relates to a chip device such as a chip resistor device and a manufacturing method therefor, in which the high density is easily realized. More specifically, the present invention relates to a chip device and a manufacturing method therefor, in which the resistivity of the chip resistor device is constantly maintained even without using silver for lowering the self resistance in portions other than the upper electrode, thereby curtailing the manufacturing cost of the chip resistor.

2. Description of the Prior Art

At present, the chip resistor devices are widely used, and the reason is to realize a high density of the electronic parts, and to make the product light, simple and miniature. In the field of resistors, the use of the chip resistor device tends to be drastically increased.

A conventional chip resistor device is disclosed in U.S. Pat. No. 5,815,065 (dated Jan. 6, 1997), and this chip resistor device is illustrated in FIGS. 1 and 2.

As shown in FIGS. 1 and 2, upon a chip substrate 110, there are printed an upper electrode 122 and a resistance film 130. Upon the resistance film 130 and the upper electrode 122, there are printed two coating layers 140*a* and 140*b* so as to protect the resistance film 130, and there are also printed a pair of auxiliary upper electrodes 122*a* each having a cut portion C so as to make it possible to easily adjust the resistance characteristics of the chip resistor device 100. On each of the both side faces of the chip substrate 110, there is formed a side electrode 124, while a terminal electrode 150 is formed on each of the side electrodes 124.

Thus, if a power is supplied through a circuit pattern, the power passes through the terminal electrode 150, the side electrode 124, the auxiliary electrode and the upper electrode 122*a* and 122, and the resistance film 130, thereby determining the resistance characteristics of the chip resistor device 100. Particularly after and during the manufacture, the total resistance value of the chip resistor device can be precisely adjusted by means of the cut portion C of the auxiliary upper electrode 122*a*.

In this conventional chip resistor device 100, as shown in FIGS. 1 and 2, the total resistance value can be adjusted after and during the manufacture of the chip resistor device 100 by means of the cut portion C of the auxiliary upper electrode 122*a* as described above. However, the power which is supplied from the circuit pattern of the circuit board passes through the terminal electrode 150, the side electrode 124, the auxiliary upper electrode 122*a*, the upper electrode 122 and the resistance film 130. Therefore if the resistivities of the respective electrodes are high, the resistance characteristics become defective. As a result, a large amount of silver (Ag) which shows the least resistivity has to be used, and this causes an increase of the manufacturing cost.

SUMMARY OF THE INVENTION

The present invention is intended to overcome the above described disadvantages of the conventional technique.

Therefore it is an object of the present invention to provide a chip resistor device and a manufacturing method therefor, in which a portion directly contacting to a terminal electrode (contacting to a circuit board) is necessarily provided so as to form a perfect bypass signal supply path. Thus electrodes other than the upper electrode can be made of materials other than silver, and therefore, the manufacturing cost for the chip resistor device can be decreased.

In achieving the above object, the chip device according to the present invention includes: a chip block having an upper face and a pair of mutually oppositely facing side faces; an electrode part having an upper electrode formed on the upper face and on the side faces of the chip block, and having a side electrode formed on the side faces of the chip block; a special electrical property layer connected to the upper electrode of the upper face of the chip block; at least one or more protecting layers formed upon the special electrical property layer to protect it; at least one or more terminal electrode layers formed on the electrode part of the chip block, and solder-connected to a circuit pattern of a circuit board; and a terminal connection part formed on the surface of the upper electrode to be directly connected to the terminal electrode at least at one point.

In another aspect of the present invention, the method for manufacturing a chip device according to the present invention includes the steps of: preparing an alumina substrate; screen-printing a plurality of lower electrodes on a lower face of the round alumina block in accordance with standards of chip resistors, and baking the lower electrodes; screen-printing a plurality of upper electrodes on an upper face of the alumina substrate in accordance with standards of chip resistors, and baking the upper electrodes; printing special electrical property layers on an upper face of the alumina block so as to be connected to the upper electrodes, and baking them; printing at least one or more protecting layers with a certain width upon the special electrical property layer to protect it by using a glass material, and baking them; breaking the alumina substrate in a lateral direction into a plurality of pieces to form a pair of mutually oppositely facing side faces, and carrying out a dipping process to print side electrodes of a certain length on the side faces of the pieces thus cut so as to form terminal connection parts contacting at least at one point to the upper electrodes, and baking them; and breaking the pieces (thus laterally cut) in a longitudinal direction to form a plurality of chip blocks, and carrying out a plating process to make a terminal electrode directly connected to the upper electrode at least at one point through the terminal connection part.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
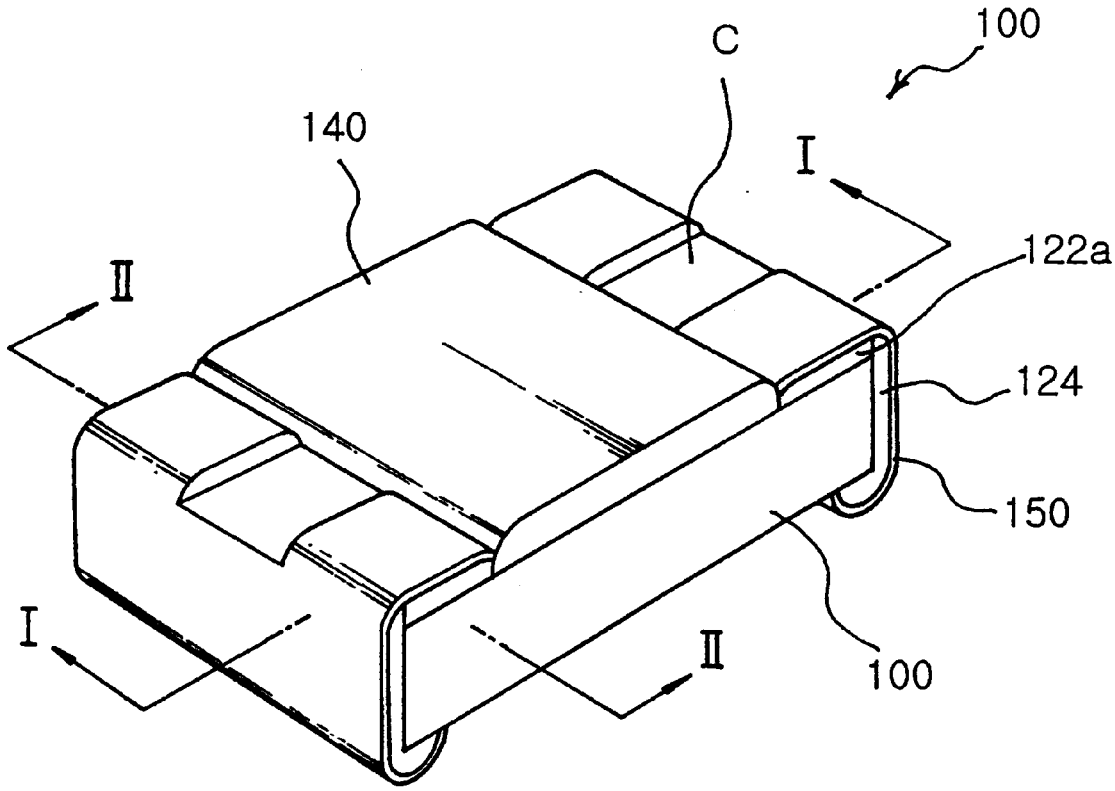
FIG. 1 is a perspective view of a conventional chip resistor device.
Figure 2A:
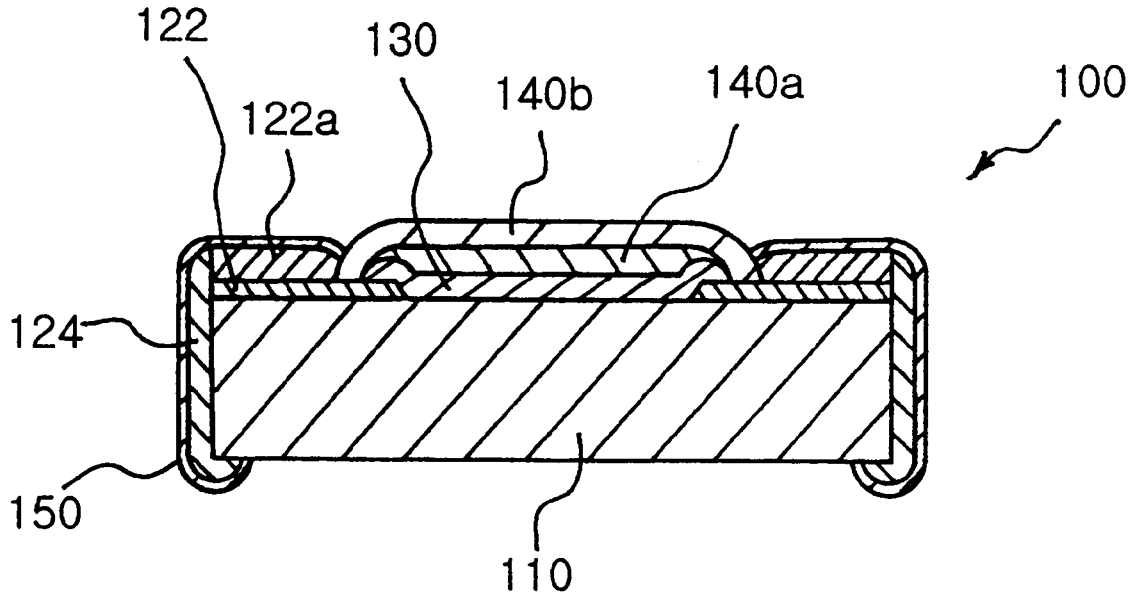
FIGS. 2*a* and 2*b* are sectional views taken along lines I—I and II—II of FIG. 1.
Figure 2B:
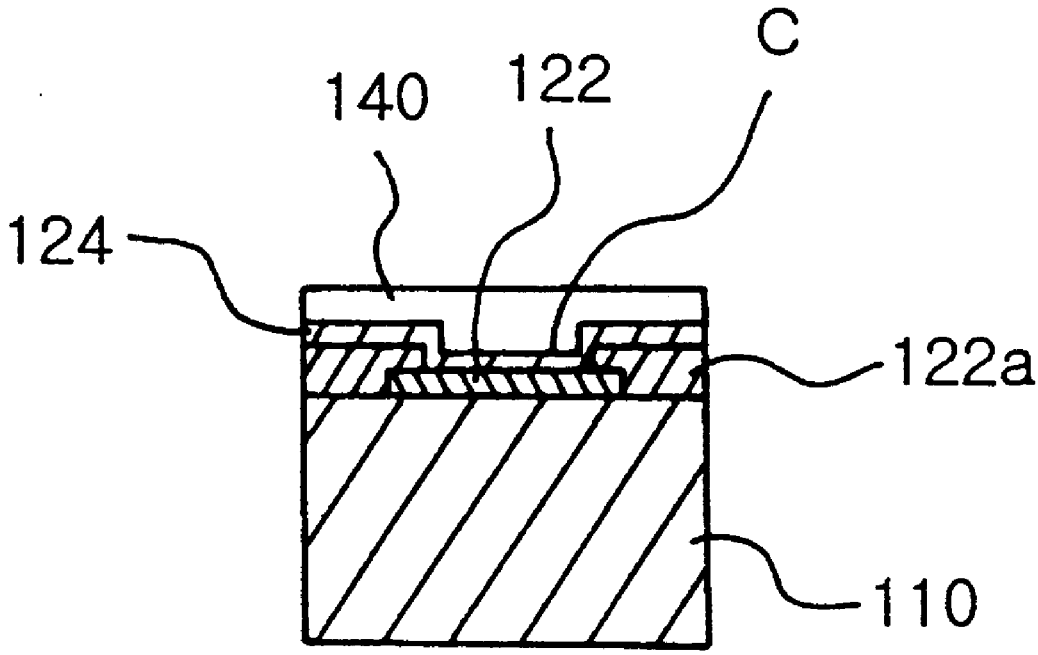
Figure 3:
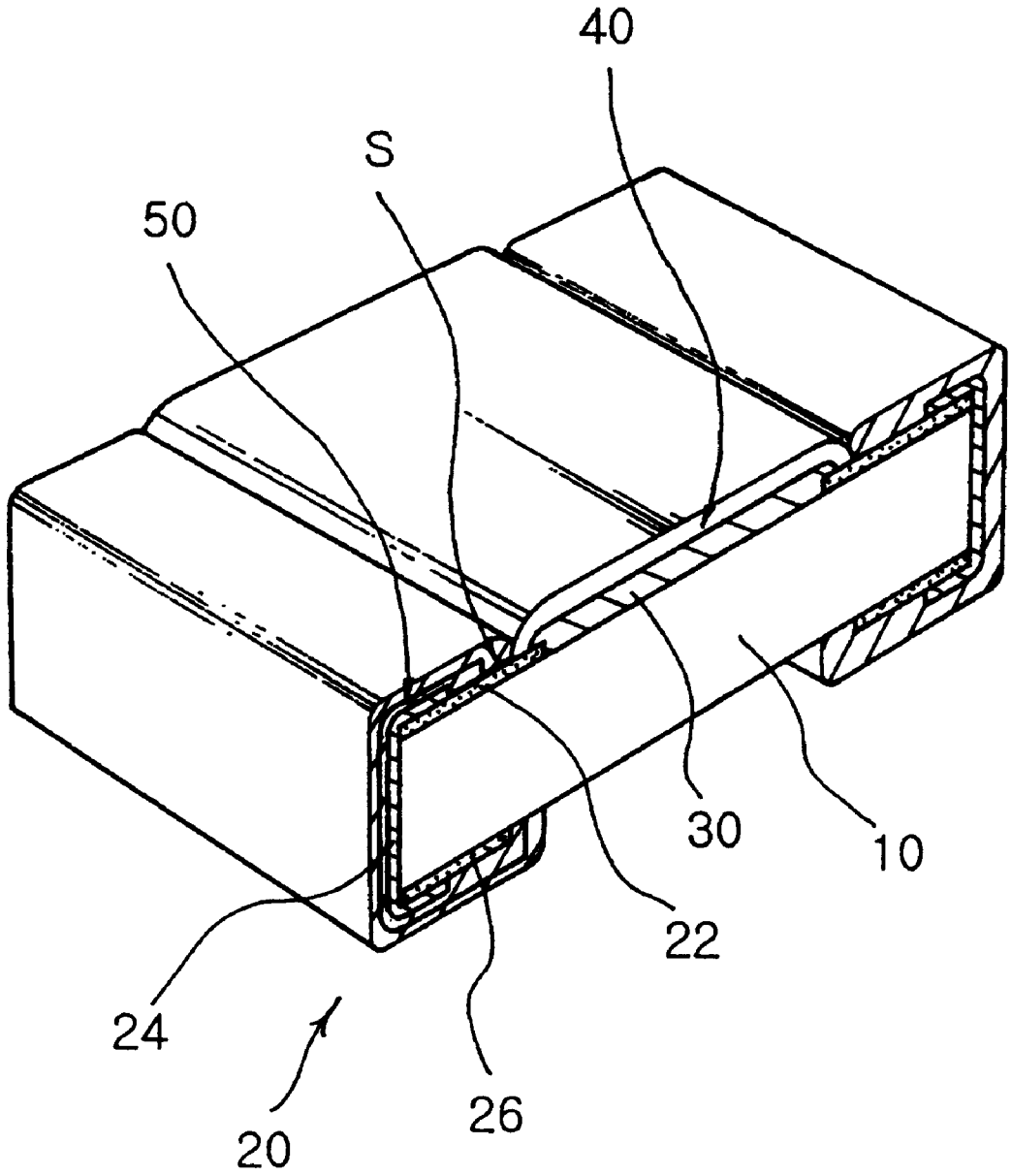
FIG. 3 is a partly cut-away perspective view of the chip resistor device according to the present invention.
Figure 4:
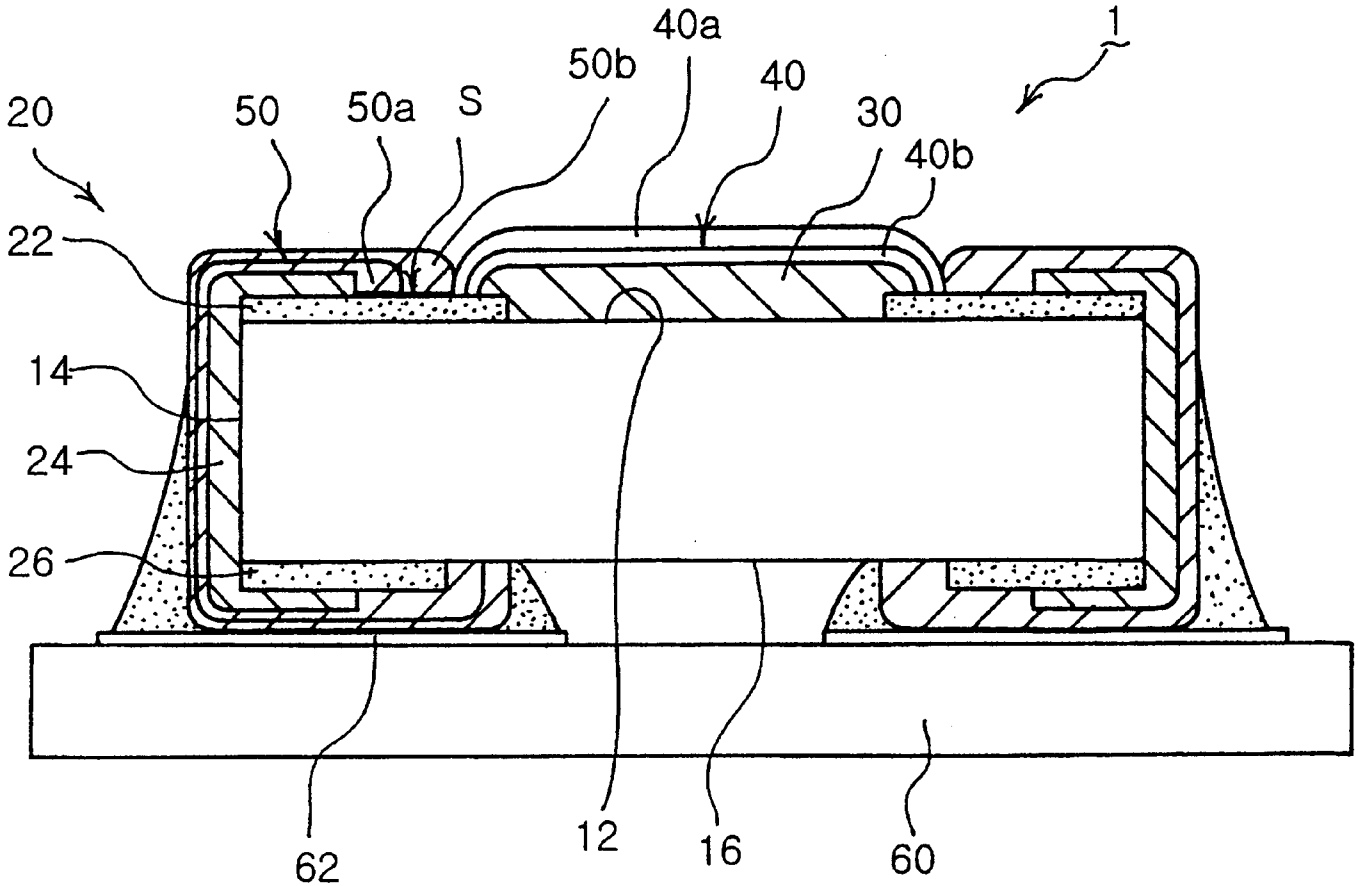
FIG. 4 is a sectional view showing the chip resistor device of the present invention installed on a circuit board.
Figure 5A:
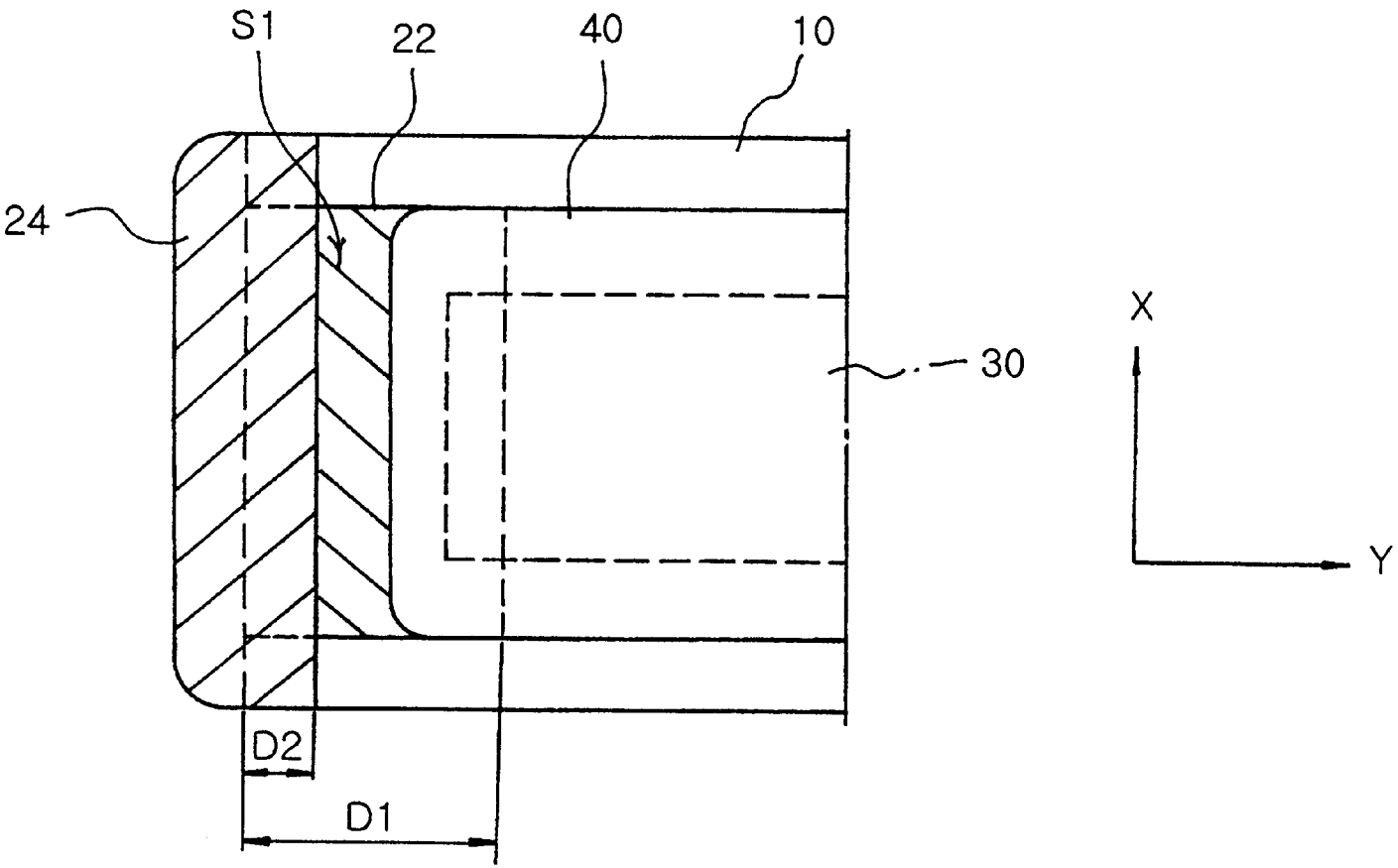
FIGS. 5*a* and 5*b* are plan views showing the terminal connection part of the chip resistor device according to the present invention.
Figure 5B:
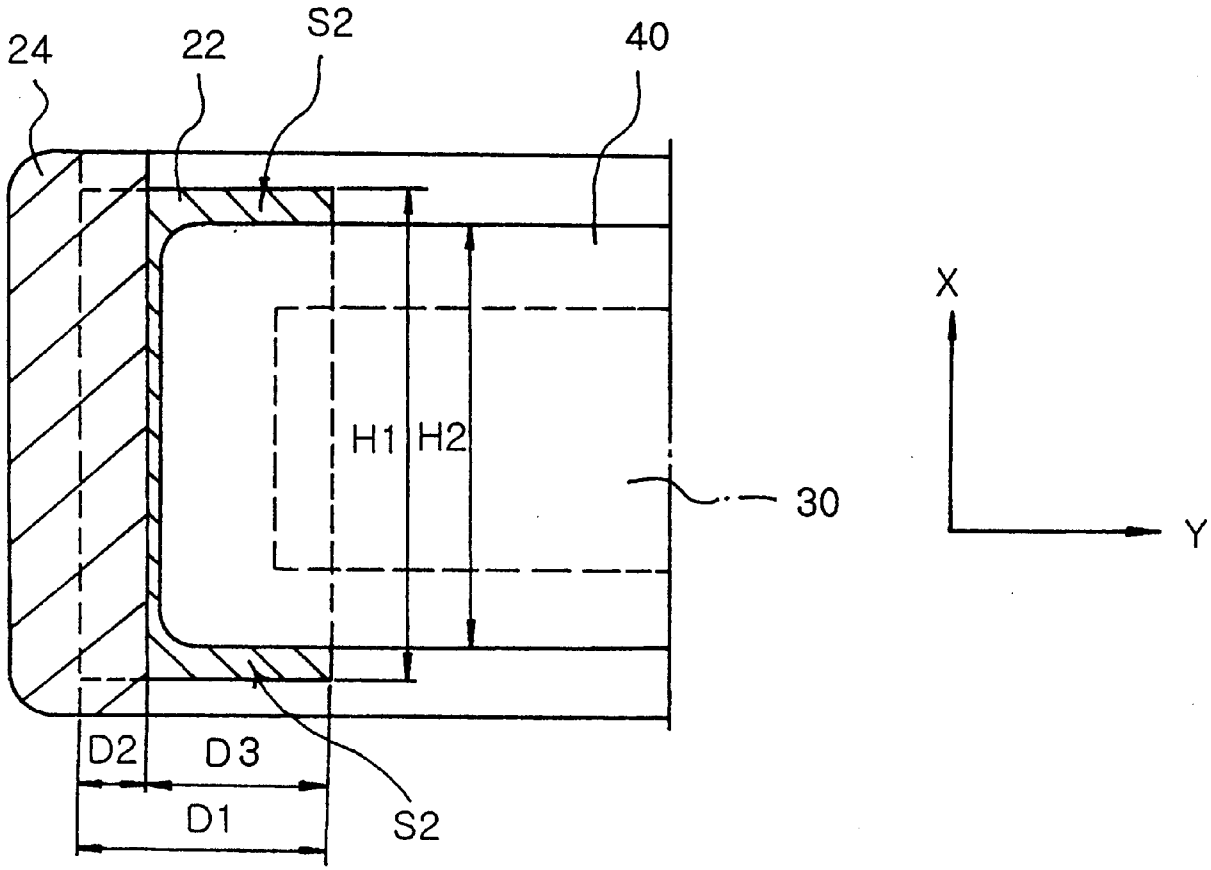

FIG. 3 is a partly cut-away perspective view of the chip resistor device according to the present invention. FIG. 4 is a sectional view showing the chip resistor device of the present invention installed on a circuit board. FIGS. 5*a* and 5*b* are plan views showing the first and second terminal connection parts S1 and S2 of the chip resistor device according to the present invention.

The chip resistor device 1 according to the present invention includes: a chip block 10 having an upper face 12 and a pair of mutually oppositely facing side faces 14; an electrode part 20 having an upper electrode 22 formed on the upper face 12 of the chip block 10, and having a side electrode 24 formed on the side faces 14 of the chip block 10; a special electrical property layer 30 connected to the upper electrode 22 of the upper face 12 of the chip block 10; at least one or more protecting layers 40*a* and 40*b* formed upon the special electrical property layer 30 to protect it; at least one or more terminal electrode layers 50*a* and 50*b* formed on the electrode part 20 of the chip block 10, and solder-connected to a circuit pattern 62 of a circuit board 60 so as to make it possible to install the chip resistor device 1.

The upper electrode 22 has a terminal connection part S which is directly connected to the terminal electrode 50 at least at one point. The terminal connection part S consists of either a first terminal connection part S1 which is formed in the perpendicular direction substantially relative to a lengthwise direction(y direction) of the chip block 10, or a second terminal connection part S2 which is formed in the lengthwise direction of the chip block, and substantially on the both sides (x direction) of the protecting layer 40), or consists of both of the first and second terminal connection parts S1 and S2.

The first terminal connection part S1 has to satisfy D1>D2, where D1 is the length of the upper electrode, and D2 is the length of the side electrode. As shown in FIG. 5B, each upper electrode 22 has a length D1 larger than the length D2 by which the respective side electrode 24 overlaps the respective upper electrode 22. Also, the length D1 of the upper electrode 22 is larger than the sum of the length D2 by which the respective side electrode 24 overlaps the respective upper electrode 22 and the length D3 by which the mono- or multi-protective layer 40 overlaps the upper face 12 of the respective upper electrode 40. In other words, D1 is larger than D2+D3. The second terminal connection part S2 has to satisfy H1>H2, where H1 is the width of the upper electrode, and H2 is the width of the protecting layer. As shown in FIG. 5B, each upper electrode 22 has a width H1 larger than the width H2 of the protective layer 40. The protecting layer 40 may be provided in an oval form.

Further, the upper electrode 22, the special electrical layer 30 and the protecting layer 40 are screen-printed, and the side face electrode 24 are printed by applying a dipping process, while the terminal electrode 50 of the electrode part 20 is formed by applying a plating process.

The upper electrode 22 contains 60 wt % or more of silver (Ag), and the side face electrode 24 contains 30 wt % or less of silver (Ag), 0.5 wt % or more of copper oxide (CuO), iron (Fe), cobalt (Co) and, glass materials and resins. Or the side face electrode 24 may contain no silver, but may contain nickel (Ni) or carbon (C).

Further, on the bottom face 16 of the chip block 10, there is formed a lower electrode 26 on which the side electrode 24 and the terminal electrode 50 are formed. The lower electrode 26 contains 40 wt % or less of silver (Ag), 20 wt % or more of copper oxide (CuO), iron (Fe), cobalt (Co) and, glass materials and resins. Or the lower electrode 26 may contain no silver, but may contain nickel (Ni) or carbon (C).

Now the present invention will be described as to its manufacturing method.

FIG. 6*a* to 6*f* are schematic perspective views showing the manufacturing process for the chip resistor device according to the present invention.

Figure 6A:
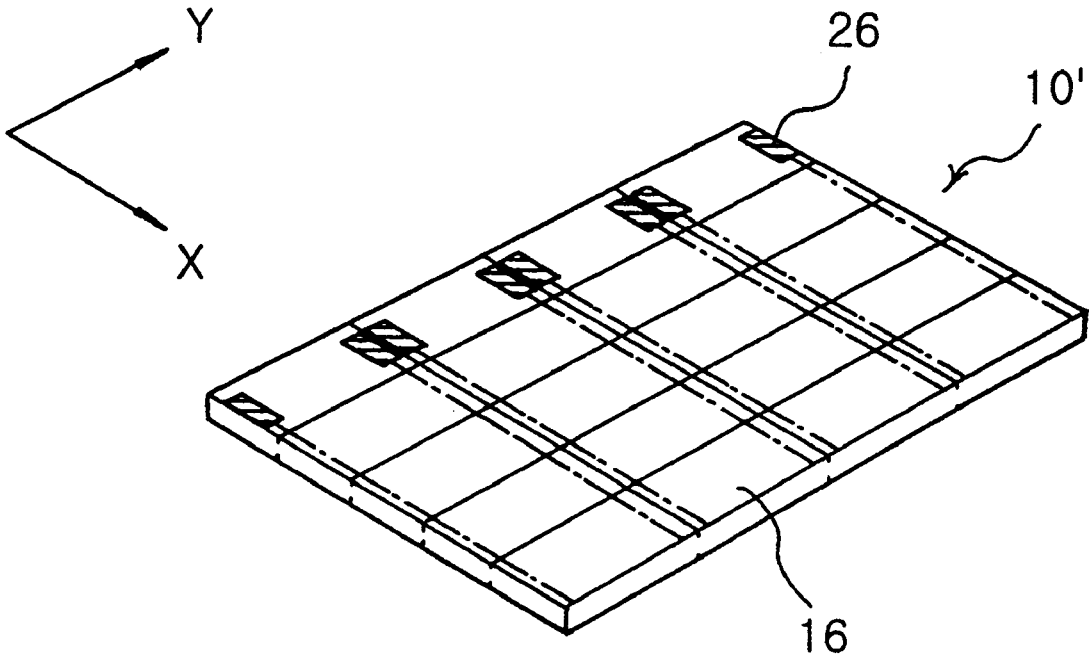
FIG. 6*a* to 6*f* are schematic perspective views showing the manufacturing process for the chip resistor device according to the present invention.

First as shown in FIG. 6*a*, an alumina substrate 10' is prepared, and the alumina substrate 10' contains 96% or more of alumina ($Al_2O_3$). Further, the block 10' has a plurality of lateral and longitudinal lines so that the alumina substrate 10' may be cut into a plurality of chip blocks 10 in accordance with the standards of the chip resistor device 1. On the bottom face 16 of the alumina substrate 10', there are screen-printed (mesh 250 T) a plurality of lower electrodes 26 with certain widths and lengths in the x and y directions in accordance with the standards of the chip resistor device 1. Then the structure is baked at a temperature of about 600° C., but the lower electrodes may not be printed depending on the kind of the chip resistor device 1.

Figure 6B:
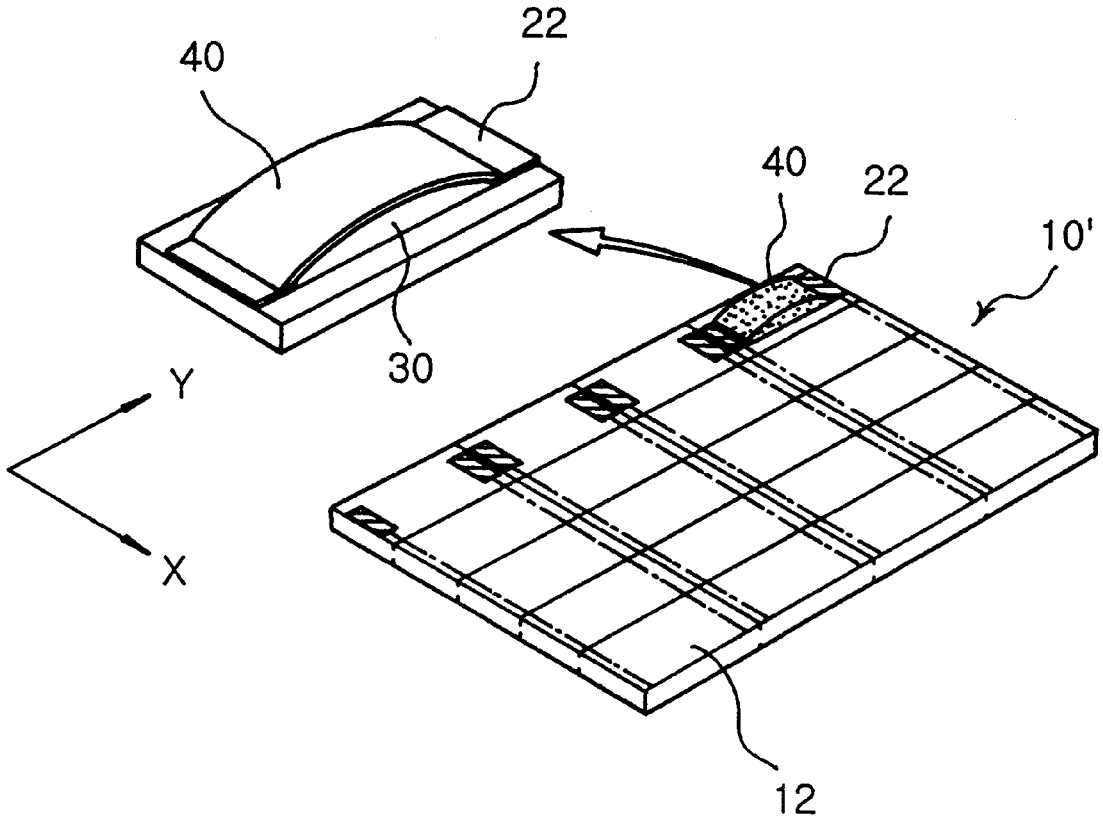
Figure 6C:
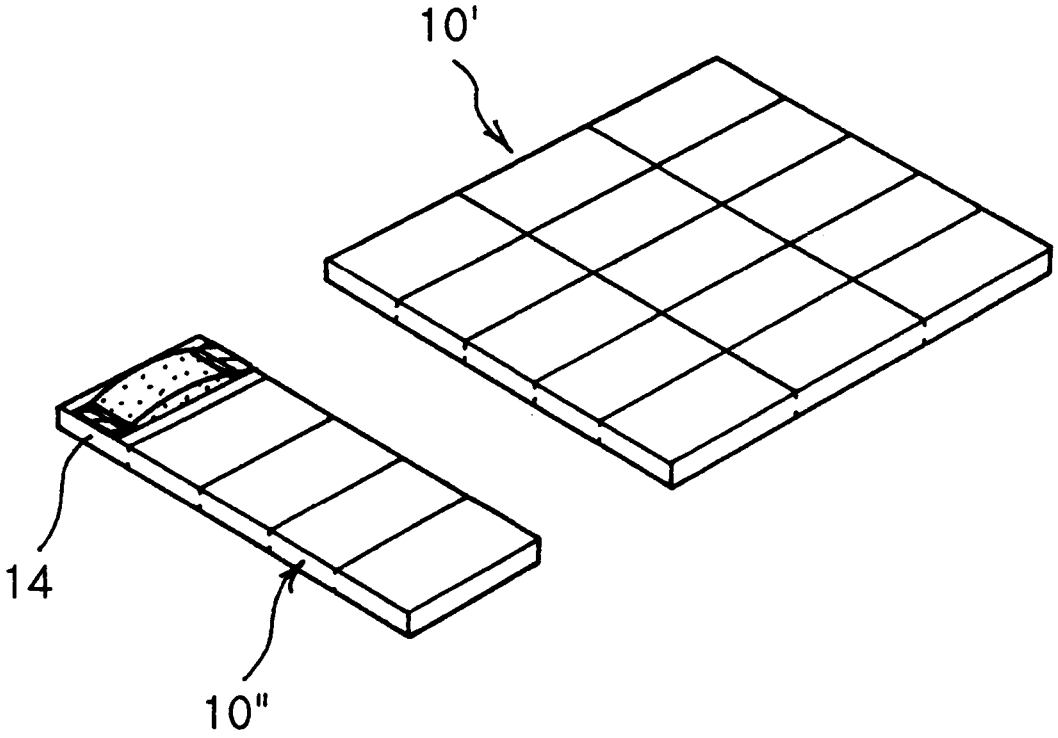

Then as shown in FIG. 6*b*, the alumina substrate 10' is set upside down, and on the upper face 12 of the block 10', there are screen-printed (mesh 305 T) a plurality of upper electrodes 22 like the lower electrodes 26 in accordance with the standards of the chip resistor device 1. Then the structure is baked at a temperature of about 600° C., and under this condition, the upper electrodes 22 are printed by using a paste containing 60 wt % or more of silver (Ag).

Then as illustrated in the detailed portion of FIG. 6*b*, special electrical property layers 30 (which are resistors) are screen-printed between the upper electrodes 22 so that the upper electrodes may be electrically conducted to each other. Then the structure is baked at a temperature of about 800° C. The layers 30 are formed by using a paste of ruthenium oxide ($RuO_2$) or by stacking resistor films. Or in the case of a jumper resistor, the special electrical property layers 30 are printed in straight lines simultaneously with the upper electrodes 22.

Under this condition, the special electrical property layers 30 actually decide the resistance characteristics of the chip resistor device 1, and therefore, their width, their length and their thickness are important. During the manufacture of the chip resistor device, after printing the layers 30, the structure is made to undergo through a trimming process, and is partly cut to adjust the resistance value of the chip resistor device 1.

Then, after the printing of the layers 30 and the completion of the baking, protecting layers 40 are screen-printed with certain widths (H2) (FIG. 5) to protect the layers 30. Then the structure is baked at a temperature of about 600° C. Usually the protecting layers 40 are made of a glass material, and depending on the kind of the chip resistor device 1, the protecting layers may consist of one or more sub-layers. That is, first and second protecting sub-layers 40*a* and 40*b* are sequentially printed, and the product number is printed on the first protecting sub-layer 40*a* before printing the second protecting sub-layer 40*b*. Or the product number is printed on the second protecting sub-layer 40*b* before printing a third protecting sub-layer (not illustrated).

Then as shown in FIGS. 3*c* and 3*d*, after the firing of the lower and upper electrodes 26 and 22, the special electrical property layers 30 and the protecting layers 40, the alumina substrate 10' is cut in the lateral direction along the mentioned lateral lines to form lateral blocks 10". Thus side faces 14 are formed on each of the lateral blocks 10", and then, side electrodes 24 are formed on the upper and lower electrodes 22 and 26.

Figure 6D:
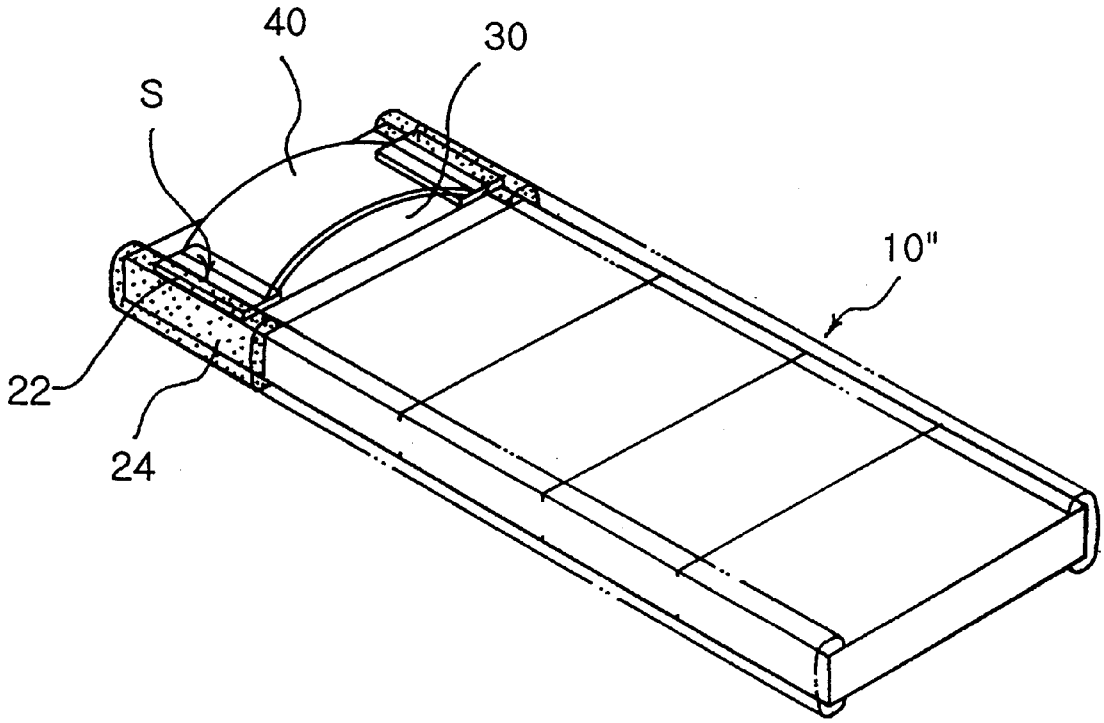
Figure 5B:
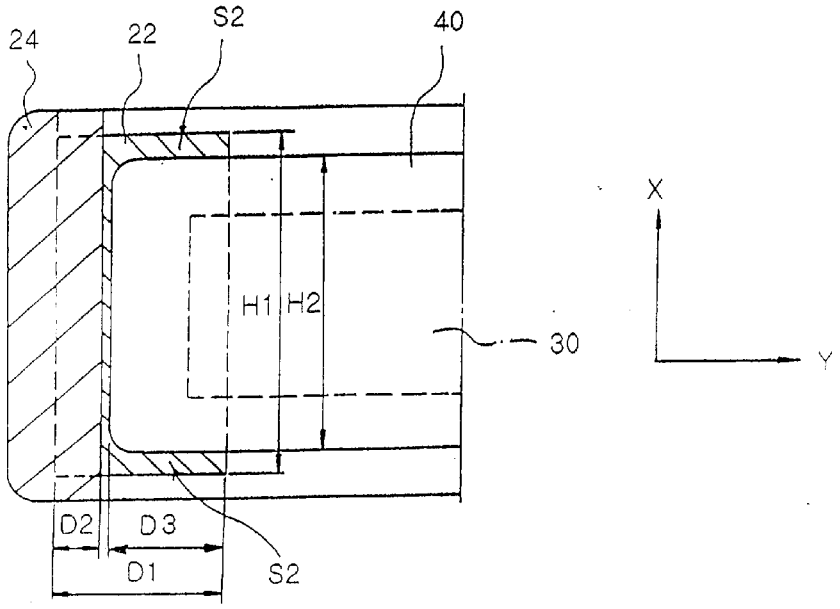

Then as shown in FIG. 6*d*, the terminal portion of the lateral alumina block 10" is dipped into a paste so as to form a side electrode 24 on the terminal portion 14 of the lateral alumina block 10". As it will be described in detail later, the side electrodes 24 has a certain length D2 (FIG. 5). The length D2 is same as the dipping depth of the alumina lateral block 10" in the dipping process.

Further, as shown in FIG. 6*d*, it is important that the side electrodes 24 should not cover the entire areas of the upper electrodes 22, but a part of the upper electrodes 22 should be exposed. As will be described later in detail, the exposure of a part of the upper electrodes 22 is for bypassing the electrical signals.

That is, as shown in FIGS. 5*a* and 5*b*, in forming the terminal exposure parts S between the upper electrodes 22 and the side electrodes 24, there are sequentially formed first and second terminal connection parts S1 and S2, or they are simultaneously formed. In the first terminal connection part S1, the length D1 of the upper electrode 22 is made longer than the length D2 of the side electrode 24. Ultimately, D1–D2 becomes the first terminal connection part S1. In forming the second terminal connection part S2, the length D1 of the upper electrode 22 is made longer than the length D2 of the side electrode 24, and the width Hi of the upper electrode 22 is made larger than the width H2 of the protecting layer 40. Ultimately, H1–H2 becomes the second terminal connection part 52.

Figure 6E:
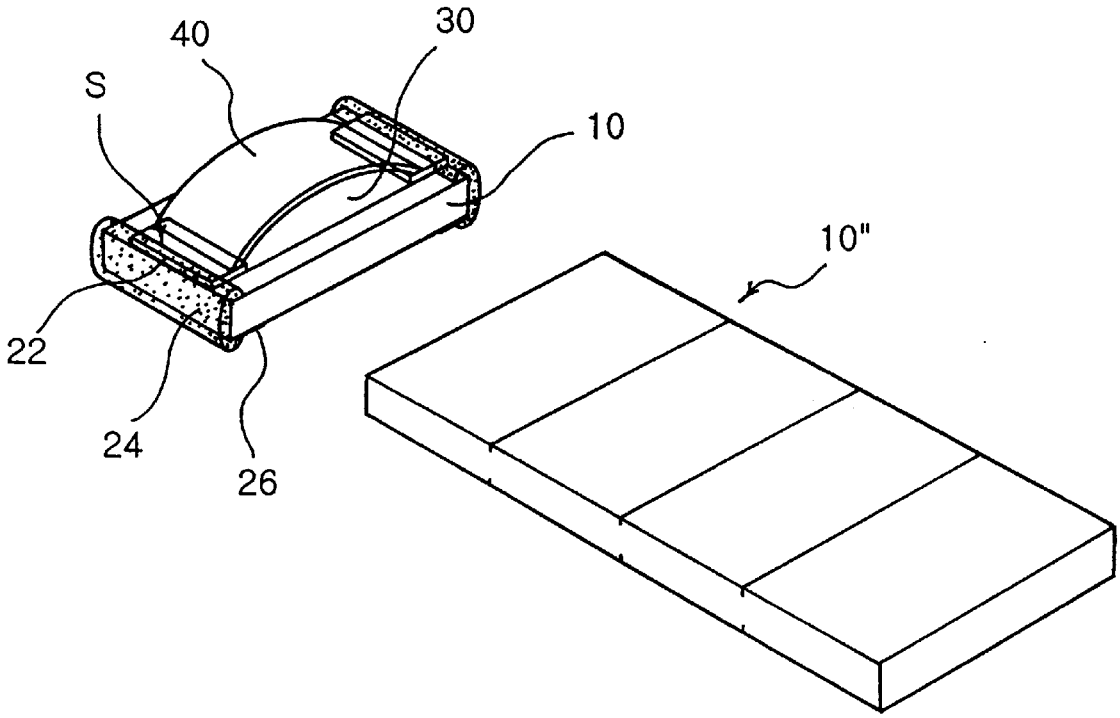
Figure 6F:
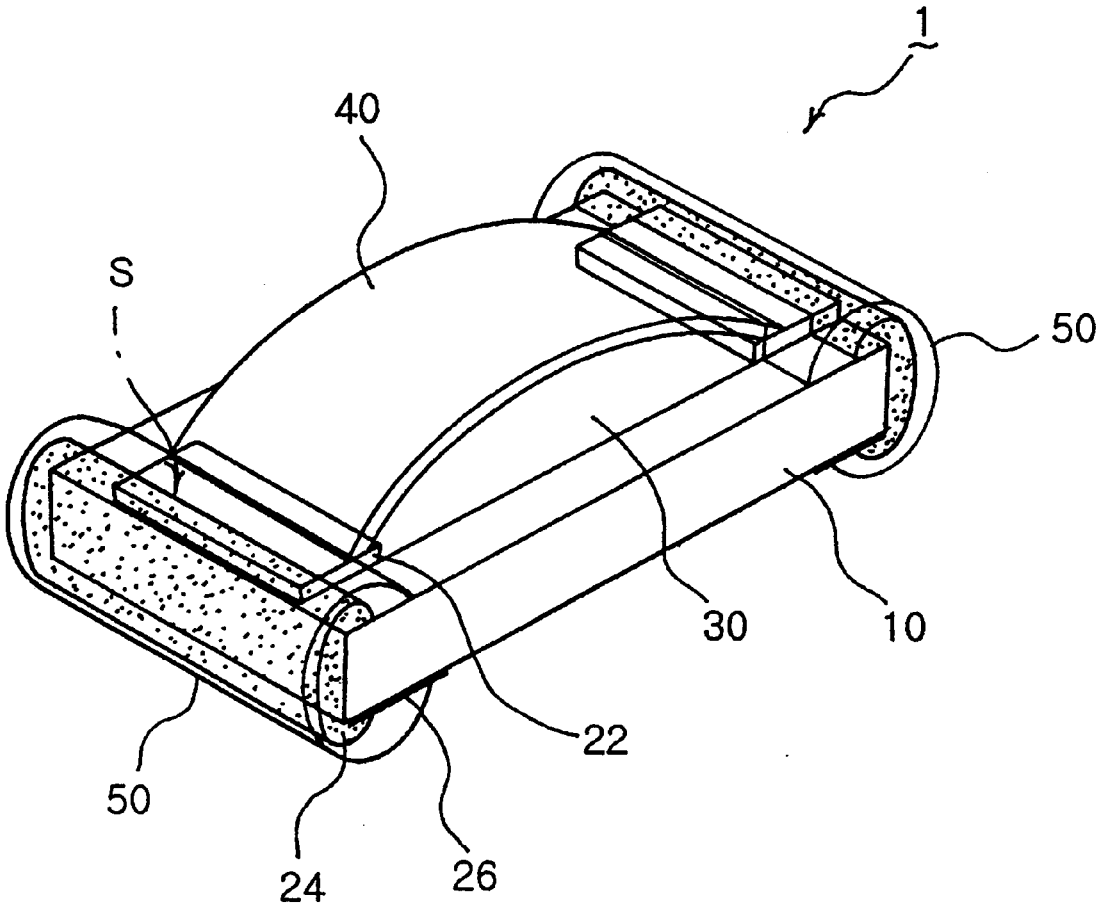

Then as shown in FIGS. 6*e* and 6*f*, the lateral blocks 10" are cut along the mentioned longitudinal lines to form chip blocks 10 which have the size of the chip resistor device 1. Then on the electrode part of each of the chip blocks 10, there is formed a terminal electrode 50 by applying a plating process. This terminal electrode 50 is soldered to a circuit pattern 62 (FIG. 4) of the circuit board 60, for serving as a terminal of the chip resistor device 1. This terminal electrodes 50 may consist of first and second terminal electrodes 50*a* and 50*b* (sequentially formed) (FIG. 4). It is important that during the plating of the terminal electrode 50, the terminal electrode 50 contacts through the terminal connection part S to the upper electrode 24 at least at one point.

Accordingly, the side and lower electrodes 24 and 26 contain 30 and 40 wt % or less of silver (Ag), 0.5 and 20 wt % or more of copper oxide (CuO), iron (fe), cobalt (Co) and, glass materials and resins. Or they may contain no silver but only contain nickel (Ni) or carbon (C). In the case of a two-layer terminal electrode 50, the first terminal electrode 50*a* is formed by applying a plating process and by using Ni, and the second terminal electrode 50*b* is formed by applying a plating process and by using Sn and Pb. In this manner, as will be described in examples 1 and 2, the side and lower electrodes contain no silver or extremely small amounts of silver so as to increase the self resistance value. However, as described above, owing to the terminal connection part S, the electrical signals which have been supplied to the terminal electrode 50 are completely bypassed through the upper electrode 22 which contains 60 wt % or more of silver (Ag). Consequently, the resistance characteristics of the chip resistor device 1 become constant. Because the expensive silver needs not be used, the manufacturing cost is curtailed.

The other ingredients versus the silver content of the side electrode 24 are shown in Table 1 below.

TABLE 1

| Silver content | CuO,Fe,Co | Glass materials | Others | Total |
|---|---|---|---|---|
| 30 or less | 0.5 or more | Minimum 10 | " | 100 |
| 25 or less | 20 or more | Minimum 10 | " | " |
| 15 or less | 30 or more | Minimum 10 | " | " |
| 5 or less | 40 or more | Minimum 10 | " | " |

(*The unit is wt %.)

The other ingredients versus the silver content of the lower electrode 26 are shown in Table 2 below.

TABLE 2

| Silver content | CuO,Fe,Co | Glass materials | Others | Total |
|---|---|---|---|---|
| 40 or less | 20 or more | Minimum 3 | " | 100 |
| 30 or less | 40 or more | Minimum 3 | " | " |
| 20 or less | 50 or more | Minimum 3 | " | " |
| 10 or less | 60 or more | Minimum 3 | " | " |

(*The unit is wt %.)

As can be seen in Tables 1 and 2 above, in the side electrode 24 and the lower electrode 26, the silver contents can be adjusted depending on the kind of the chip resistor device 1, and the electrodes 24 and 26 may contain no silver at all. Preferably the silver contents may be reduced as far as possible to save the manufacturing cost. The respective ingredients may be adjusted depending on the kinds of the chip resistor device 1. Particularly, as can be seen in Tables 1 and 2, the side and lower electrodes 24 and 26 contain no Pb at all unlike the conventional method, thereby eliminating the harmful elements (harmful to the human bodies). Further, the side electrode 24 is dipping-printed, and the lower electrode 26 is screen-printed, with the result that there is a difference in the content of the glass material.

Figure 7:
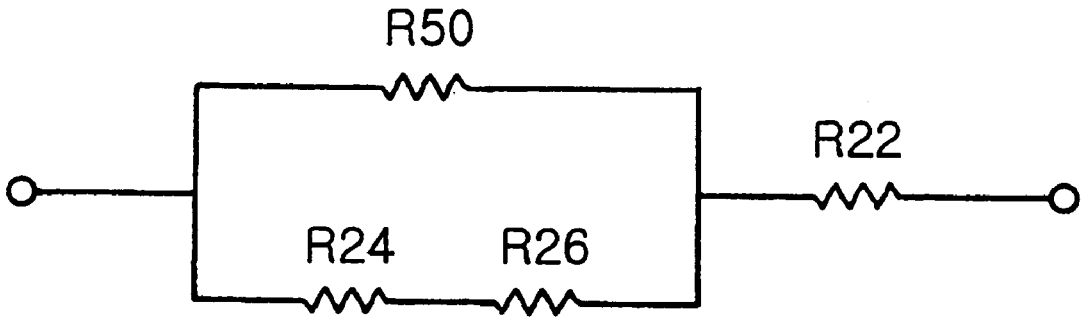
FIG. 7 is a circuit diagram showing the signal bypassing chip resistor device according to the present invention.

Meanwhile referring to FIG. 7, the completely signal bypassing chip resistor device 1 will be described.

If the self resistance value R22 of the upper electrode 22 is extremely low, even if the self resistance values R24 and R26 of the side and lower electrodes 24 and 26 are high, that is, if the terminal connection part S is formed on the upper electrode 22 as described above, and if the side and lower electrodes 24 and 26 contain 30 and 40 wt % or less of silver, or contain no silver but only Ni or C, then the overall resistance characteristics will satisfy the following formulas 1 and 2:

$$R_{total} = \frac{R50 \times (R24 + R26)}{R50 + R24 + R26} + R22 = R50 \times \left(\frac{R24 + R26}{R50 + R24 + R26}\right) + R22 \quad \text{(Formula 1)}$$

where R50, R24, R26>0, and R22, R24, R26 and R50 are the resistance values of the upper, side, lower and terminal electrodes. Therefore, Formula 2 will be satisfied.

$$\frac{R24 + R26}{R50 + R24 + R26} < 1 \quad \text{(Formula 2)}$$

This is because the denominator is larger than the numerator. In a parallel circuit, the total resistance $R_{totaL}$ is R50 multiplied by a number smaller than 1. Therefore, even if the self resistance values of R24 and R26 are large, the total resistance value $R_{totaL}$ approximately equals to R50+R22 which approximately equals to R22. Thus if the terminal electrode 50 is directly connected to the upper electrode 22, that is, if the terminal connection part S is formed, then only the upper electrode should be made of the expensive silver, while the other electrodes may not contain silver at all.

Now the present invention will be described based on actual examples.

EXAMPLE 1

In this example, the chip resistor device 3216 was adopted, and the resistor device had a size of 3.2×1.6 mm, and a resistance of 0.05Ω at the maximum.

An alumina disc block 10' containing 96% of alumina was prepared. On the lower face 16 of the block 10', a plurality of lower electrodes 26 were printed in a size of 0.35×1.15 mm by using an electrode paste (mesh 303 T). Then the structure was baked at a temperature about 600° C. Then the block 10' was set upside down, and then, upper electrodes 22 were printed on the upper face 12 of the block 10' in a size of 0.85×1.15 mm in accordance with the standards of the chip resistor device in the same manner as that of the lower electrodes 26. Then the structure was baked.

Then on the upper face 12 of the block 10', resistors (the layer 30) were screen-printed in a size of 1.9×1.0 mm and in a thickness of 18 μm by using a ruthenium oxide paste and by using a mesh 250 T net, so as for the resistors to be connected to the upper electrodes 22. Then a baking was carried out at a temperature of 800° C. Thereupon, first protecting layers 40*a* were screen-printed in a size of 2×1.2 and in a thickness of 16 μm by using a mesh 305 T net. Then thereupon, second protecting layers 40*b* were screen-printed in a size of 2.2×1.2985 mm and in a thickness of 27–30 μm. Then a baking was carried out at a temperature of about 600° C.

Then the alumina substrate 10' was breaked in the lateral directions suitably to the length of the chip resistor device 1 so as to form lateral blocks 10". The end portions of the lateral blocks 10" were dipped into a electrode paste, and thus side electrodes 24 were formed in a length of 0.2 mm.

Thus a terminal connection part S with a size of 0.2 mm was formed on each of the upper electrodes 22. Then the lateral block 10" was cut in the longitudinal directions, and then, terminal electrodes 50 were formed on the electrodes 22, 24 and 26 by applying a plating process through two process steps.

Then adopting the lower electrode 26 of the chip resistor device 1 as the measuring point, 15 of the chip resistor devices of present invention (having the terminal connection part S on the upper electrode 22) and 15 of the conventional chip resistor device were sampled for measurements. The results of the measurements are shown in Table 3 below.

TABLE 3

| Classification | Self resistance values of side electrode + lower electrode | Resistance value of product having exposed area | Classification | Self resistance values of side electrode + lower electrode | Resistance value of product |
|---|---|---|---|---|---|
| Chip resistor device of the present invention having | 27000 | 0.02450 | Conventional chip resistor device without terminal | 0.0668 | 0.02960 |
| | 29000 | 0.02512 | | 0.0523 | 0.02830 |
| | 2400 | 0.02738 | | 0.0491 | 0.02810 |
| | 7600 | 0.02740 | | 0.0448 | 0.02790 |
| | 9400 | 0.02820 | | 0.0891 | 0.03130 |
| | 7600 | 0.02603 | | 0.0478 | 0.02810 |

TABLE 3-continued

| Classification | Self resistance values of side electrode + lower electrode | Resistance value of product having exposed area | Classification | Self resistance values of side electrode + lower electrode | Resistance value of product |
|---|---|---|---|---|---|
| terminal connection part | 35000 | 0.02780 | connection part | 0.0422 | 0.02600 |
| | 11000 | 0.02460 | | 0.0484 | 0.02940 |
| | 12000 | 0.02500 | | 0.0450 | 0.02930 |
| | 27000 | 0.02440 | | 0.0453 | 0.02900 |
| | 30000 | 0.02850 | | 0.0330 | 0.02690 |
| | 1800 | 0.02700 | | 0.0430 | 0.02860 |
| | 11000 | 0.02630 | | 0.0485 | 0.03720 |
| | 74000 | 0.02200 | | 0.0437 | 0.03070 |
| | 29000 | 0.02500 | | 0.0478 | 0.02650 |
| Average | 20920 | 0.02595 | Average | 0.04979 | 0.02913 |

As shown in Table 3 above, in the case where an exposed area S is present on the upper electrode 22 of the chip resistor device 1, the average self resistance values of the side and lower electrodes 24 and 26 with the respective silver contents of 30 and 40 wt % were 20.9 KΩ. Meanwhile, the average self resistance values of the side and lower electrodes of the conventional chip resistor device 100 without an exposed area S were 0.0497Ω. However, in the chip resistor device of the present invention, the terminal electrode 50 was directly connected to the upper electrode 22 so as to form a signal bypassing path. Therefore, the chip resistor device of the present invention showed an actual resistance value of 0.02595Ω which was lower than the average resistance value of 0.02913Ω of the conventional chip resistor device 100.

Therefore, even if the side and lower electrodes 24 and 26 do not contain silver or do contain silver in small amounts to raise the self resistance values, the resistance characteristics of the chip resistor device of the present invention are stable. If this chip resistor device 1 is used, a monthly saving of several million Korean wons is possible in the case of the chip resistor device 3216.

EXAMPLE 1

In this example, the case where the side and lower electrodes 24 and 26 contained no silver was compared with the case where the electrodes 24 and 26 contained large amounts of silver. That is, the resistance characteristics of the two cases of a chip resistor device without the terminal connection part S were compared.

Then adopting the lower electrode 26 of the chip resistor device 1 as the measuring point, 15 of the chip resistor devices were sampled for measurements. In this example, the chip resistor device 1608 (1.6×0.8 mm) was adopted, and measurements were carried out. The measured results are shown in Table 4 below.

TABLE 4

| Classification | Self resistance values of non-silver side electrode + lower electrode | Resistance value of product | Classification | Self resistance values of silver-containing side electrode + lower electrode | Resistance value of product |
|---|---|---|---|---|---|
| Chip resistor device | 1110 | 2245 | Chip resistor device | 0.0668 | 0.02960 |
| | 464 | 5596 | | 0.0523 | 0.02830 |
| | 775 | 1471 | | 0.0491 | 0.02810 |
| | 357 | 1104 | | 0.0448 | 0.02790 |
| | 1462 | 1831 | | 0.0891 | 0.03130 |
| | 824 | 1096 | | 0.0478 | 0.02810 |
| | 1875 | 3338 | | 0.0422 | 0.02600 |
| | 1020 | 1668 | | 0.0484 | 0.02940 |
| | 1060 | 1271 | | 0.0450 | 0.02930 |
| | 1360 | 1945 | | 0.0453 | 0.02900 |
| | 421 | 1570 | | 0.0330 | 0.02690 |
| | 1842 | 0830 | | 0.0430 | 0.02860 |
| | 710 | 1031 | | 0.0485 | 0.03720 |
| | 375 | 0.230 | | 0.0437 | 0.03070 |
| | 514 | 1198 | | 0.0478 | 0.02650 |
| Average | 945 | 176267 | Average | 0.04979 | 0.02913 |

As can seen in Table 4 above, the average self resistance value was 945Ω in the chip resistor device without a terminal connection part S and with side and lower electrodes 24 and 26 containing no silver. Therefore, the resistance value of the chip resistor device 1 was 1.76267Ω which was much higher than 0.02913Ω of the conventional chip resistor device. This shows that if the self resistance is high, and if there is no terminal connection part S, then the signal bypassing path cannot be formed. Therefore, the chip resistor device becomes unstable, and the total resistance value becomes high.

Accordingly, even if the side and lower electrodes 24 and 26 contain no silver, if there is provided the terminal connection part S for connecting the terminal electrode 50 to the upper electrode 22 at least at one point, then the resistance characteristics of the chip resistor device 1 is constantly maintained, and the manufacturing cost can be saved.

According to the present invention as described above, a terminal connection part is formed to connect the terminal electrode directly to the upper electrode so as to form a signal bypassing path. Accordingly, the upper electrode which directly contacts with the special electrical property layer should contain silver, but the other electrodes such as the side electrode, the lower electrode and the terminal electrode can be minimized in the silver contents. In spite of this fact, the chip resistor device according to the present invention can maintain a constant resistance value, and ultimately, the manufacturing cost can be curtailed.

In the above, the present invention was described based on the specific preferred embodiment and the drawings, but it should be apparent to those ordinarily skilled in the art that various changes and modifications can be added without departing from the spirit and scope of the present invention which will be defined in the appended claims.

What is claimed is:

1. A chip device, comprising:

a chip block having an upper face and a pair of mutually oppositely facing side faces;

a pair of upper electrodes respectively formed on opposite end regions of the upper face of the chip block;

a pair of electrode parts each having a side electrode formed on a respective one of the side faces of said chip block and on an end region of an upper face of a respective one of the upper electrodes;

a resistor layer formed on the chip block, the resistor layer contacting the upper electrodes;

a mono- or multi-protective layer formed on the resistor layer to protect the resistor layer, the protective layer overlapping the upper face of each one of the upper electrodes at a position opposite the respective electrode part; and a mono- or multi-terminal electrode layer formed on the electrode part of the chip block, wherein each upper electrode has a width larger than the width of the protective layer, and each upper electrode has a length larger than the length by which the respective side electrode overlaps the respective upper electrode.

2. The chip device as claimed 1, in claim wherein said protecting layer is oval.

3. The chip device as claimed in claim 1, wherein said resistor layer is made of ruthenium oxide ($RuO_2$).

4. The chip device as claimed in claim 1, wherein said pair of upper electrodes, said resistor layer and said mono- or multi-protective layer are screen-printed.

5. The chip device as claimed in claim 1, wherein said side electrode is formed by applying a dipping process.

6. The chip device as claimed in claim 1, wherein said mono- or multi-terminal electrode layer is formed by applying a plating process.

7. The chip device as claimed in claim 1, wherein said upper electrode contains 60 wt % or more of silver (Ag).

8. The chip device as claimed in claim 1, wherein said side electrode is made of a composition comprising Ag 30 wt % or less, a mixture of CuO, Fe and Co 0.5 wt % or greater, glass 10 wt % or greater, and a resin.

9. The chip device as claimed in claim 1, wherein said side electrode contains no silver at all.

10. The chip device as claimed in claim 9, wherein said side electrode containing no silver contains nickel (Ni) or carbon (C).

11. The chip device as claimed in claim 1, further comprising a lower electrode formed on a bottom face of said chip block, and with said side electrode and said mono- or multi-terminal electrode layer formed thereon.

12. The chip device as claimed in claim 11, wherein said lower electrode is made of a composition comprising Ag 30 wt % less a mixture of CuO, Fe and Co 20 wt % or greater, glass 3 wt % or greater, and a resin.

13. The chip device as claimed in claim 11, said lower electrode contains no silver at all.

14. The chip device as claimed in claim 13, wherein said lower electrode containing no silver contains nickel (Ni) or carbon (C).

15. The chip device as claimed in claim 1, wherein said chip block contains 96 wt % of alumina.

16. The chip device as claimed in claim 1, wherein the length of the upper electrode is larger than the sum of the length of the length by which the respective side electrode overlaps the respective upper electrode and the length by which the mono- or multi-protective layer overlaps the upper face of the respective upper electrode.

* * * * *

UNITED STATES PATENT AND TRADEMARK OFFICE

CERTIFICATE OF CORRECTION

PATENT NO. : 6,359,546 B1
DATED : March 19, 2002
INVENTOR(S) : Soon Hee Oh

It is certified that error appears in the above-identified patent and that said Letters Patent is hereby corrected as shown below:

Drawings,
Delete Drawing sheet 7, and substitute therefor the Drawing sheet, consisting of Fig. 5B, as shown on the attached page.

Signed and Sealed this

Tenth Day of September, 2002

*Attest:*

*Attesting Officer*

JAMES E. ROGAN
*Director of the United States Patent and Trademark Office*